United States Patent [19]

Wong et al.

[11] Patent Number: 4,830,945

[45] Date of Patent: May 16, 1989

[54] LIQUID ELECTROPHOTOGRAPHIC DEVELOPER COMPRISING OPPOSITELY CHARGED TONER PARTICLES AND DYES OF DIFFERENT COLORS

[75] Inventors: Raymond W. Wong, Mississauga; Stephan Drappel, Toronto; Melvin D. Croucher, Oakville, all of Canada

[73] Assignee: Xerox Corporation, Stamford, Conn.

[21] Appl. No.: 197,130

[22] Filed: May 23, 1988

[51] Int. Cl.[4] ..... G03G 9/12

[52] U.S. Cl. ..... 430/114; 430/115; 430/106; 430/45; 430/904

[58] Field of Search ..... 430/106, 114, 115, 904, 430/45

[56] References Cited

U.S. PATENT DOCUMENTS

| | | | |
|---|---|---|---|
| 3,013,890 | 12/1961 | Bixby | 430/110 |
| 3,793,205 | 2/1974 | Melcalfe et al. | 252/62.1 |
| 4,078,929 | 3/1978 | Gundlach | 430/31 |
| 4,264,185 | 4/1981 | Ohta | 355/4 |
| 4,312,932 | 1/1982 | Hauser et al. | 430/45 |
| 4,476,210 | 10/1984 | Croucher et al. | 430/114 |
| 4,500,616 | 2/1985 | Haneda et al. | 430/45 |
| 4,524,117 | 6/1985 | Maekawa et al. | 430/44 |
| 4,686,163 | 8/1987 | Seung et al. | 430/47 |

FOREIGN PATENT DOCUMENTS

| | | |
|---|---|---|
| 1225049 | 2/1985 | Fed. Rep. of Germany . |
| 56-87061 | 4/1983 | Japan . |
| 55-124156 | 5/1987 | Japan . |
| 6919431 | 11/1986 | Netherlands . |
| 2169416A | 8/1986 | United Kingdom . |

*Primary Examiner*—J. David Welsh

*Attorney, Agent, or Firm*—Judith L. Byorick

[57] ABSTRACT

Disclosed is an electrophotographic liquid developer composition comprising a liquid medium, first toner particles charged to one polarity and comprising a first dye and polymeric cores to which steric stabilizer polymers have been attached, second toner particles charged to a polarity opposite to that of the first toner particles and comprising a second dye of a different color than the first dye and polymeric cores to which steric stabilizer polymers have been attached, and a charge director. The disclosed developer is suitable for developing electrostatic latent images in two different colors in a single development step. The latent image comprises three areas of charge, toner particles of one color are selectively attracted to one area, toner particles of the other color are selectively attracted to the second area, and the third area remains undeveloped as a background area.

19 Claims, No Drawings

LIQUID ELECTROPHOTOGRAPHIC DEVELOPER COMPRISING OPPOSITELY CHARGED TONER PARTICLES AND DYES OF DIFFERENT COLORS

BACKGROUND OF THE INVENTION

The present invention is directed to a liquid developer composition especially suitable for generating two-color images. More specifically, the present invention is directed to a developer useful, for example, in a process wherein electrostatic latent images formed on the surface of an imaging member in an imaging apparatus are developed in a single step with a liquid developer containing first and second toner particles of opposite polarities, wherein the first and second toner particles are of different colors.

Electrophotographic image formation wherein a two-color image is developed in a single step can be performed either with a dry developer or with a liquid developer. With a dry developer, the latent image may be developed in a single step with a developer composition wherein toner particles of opposite charge and different colors are present in a developer housing, and toner particles of each color are selectively attracted to different portions of the latent image to result in a two-color developed image. Development of two-color images according to this process and with a liquid developer functions in a similar manner. One problem, however, that arises with the liquid developers relates to the colloidal stability of the developer composition. When a liquid medium contains toner particles of two different colors and opposite polarities, the particles will tend to attract each other to form particle agglomerations or aggregates with no net charge. Since the agglomerations or aggregates are essentially neutral with respect to charge, development is difficult or substantially nonexistent, since the mutual attraction between the particles is greater than the attraction between the particles and the portions of the latent image with opposite polarity.

Accordingly, a major difficulty in formulating liquid developers suitable for developing two-color images in a single step or pass is the preparation of a colloidally stable developer composition, wherein the oppositely charged toner particles do not agglomerate or aggregate to an extent that renders development difficult or impossible, or that results in poor quality images. The developer compositions of the present invention are intended to overcome this difficulty. One embodiment of the present invention comprises an electrophotographic developer composition comprising a liquid medium, first toner particles charged to one polarity and which comprise a first dye of one color and polymeric cores to which steric stabilizer polymers have been attached, second toner particles charged to a polarity opposite to that of the first toner particles which comprise a second dye of a color different from the color of the first dye and polymeric cores to which steric stabilizer polymers have been attached, and a charge director.

Methods of generating two-color electrophotographic images are known. For example, U.S. Pat. No. 4,264,185, the disclosure of which is totally incorporated herein by reference, discloses an apparatus for developing images of two different colors. The apparatus of this patent is used in a development process wherein an electrostatic latent image of two different polarities is created on the imaging member and dry toner particles of opposite polarities, which are kept in two separate housings, are applied to the bipolar latent image for development. Preferably, the two toners are applied sequentially; in all instances, the two toners must be kept separate to prevent them from attracting each other such that their opposite charges are neutralized and both toners become incapable of developing latent images.

Another reference, U.S. Pat. No. 4,500,616, the disclosure of which is totally incorporated herein by reference, also discloses a method for developing two-color images with dry toner. According to this method, images of both positive and negative polarities are generated on a two-layered imaging member by means of a multi-stylus electrode, followed by development with two toners of different colors and opposite polarity. These two toners are mixed together to form one complex developer composition, and each image is developed under a magnetic bias by a process wherein the toner of one polarity is selectively extracted from a second toner of opposite polarity in the presence of an alternating field. This patent is directed to an imaging method employing multiple pass developement.

U.S. Pat. No. 4,524,117, the disclosure of which is totally incorporated herein by reference, also directed to a multiple pass development method, discloses a method for the formation of two-colored images simultaneously. The method comprises uniformly charging a photoreceptor with a photoconductive layer sensitive to a first color, exposing a two-colored original permitting the formation on the photoconductive layer of a latent image corresponding to a second color region in the original with the same polarity as the electric charges on the surface of the photoconductive layer. Thereafer, the photoreceptor is subjected to reversal development by the use of a photoconductive color toner charged with the same polarity as the electric charges constituting the latent image whereby the non-charged region with the photoconductive color toner is developed, followed by subjecting the latent image to a normal development treatment by the selection of an insulative toner with a color different than the color of the photoconductive color toner, and charging the color toners on the photoconductive layer with a different polarity from the charging polarity. Following the simultaneous exposure of the original through a filter shielding the first color, there is formed a two-color image corresponding to the original. Methods for developing two-color images from latent images of positive and negative polarities by exposing them to two toners of different color and opposite polarity are also disclosed in Japanese Pat. No. 56-87061 and Japanese Pat. No. 58-48065.

In addition, U.S. Pat. No. 3,013,890, the disclosure of which is totally incorporated herein by reference, discloses a method of producing two-color images in which a charge pattern is developed with a single, two-color dry developer. The developer comprises toner particles of two different colors and opposite polarities and a single carrier capable of supporting both positively charged toner particles and negatively charged toner particles. According to this method, positively charged areas are developed with the negative toner particles, and negatively charged areas are developed with the positive toner particles. When the charge pattern includes both positive and negative polarities, a two-color image results. Further, U.S. Pat. No. 4,312,932, the disclosure of which is totally incorporated herein by reference, discloses a color dry developing composition which obtains color images utilizing a single pass xerographic imaging system. The composition comprises toner resin particles containing up to four pigments and a single carrier. Corona charging may be used as a method of charging.

Liquid electrophotographic developers are also known. For example, Netherlands Pat. No. 6,919,431 discloses a liquid electrophotographic developer containing a plurality of first particles and a plurality of second particles suspended in a liquid carrier medium. The first particles are electrical insulators, while the second particles have a tendency to assume the polarity of the field of the image. The first particles also tend to adhere to the surface of the image, while the second particles tend to be repelled, which leads to uniform development and no depositing of developer in non-image areas.

German Pat. No. 1,225,049 discloses a process for producing a liquid electrophotographic developer by dispersing two oppositely charged toners in a carrier liquid, characterized in that two oppositely charged toners are used and their particles agglomerate to result in a composite particle of reduced charge. In the composite particles thus formed, one part has a positive charge and the other part has a negative charge. The resultant charge depends on which part has the greater charge; in any case, the resultant charge on the composite particle is lower than the individual charges on the original particles. The process disclosed by this patent yields a developer from which a larger number of toner particles are deposited on the latent image than with developers not containing composite particles, which results in improved image density.

Japanese Pat. No. 55-124156 discloses a method for developing two-color images with a liquid developer. The developer composition comprises two kinds of insulating liquids of different specific gravities that do not mix with or dissolve in each other, such that two separate phases exist in the solution. One toner is contained in the first liquid, and another toner of different color and opposite polarity with respect to the first toner is contained in a second liquid. Since the liquids maintain separate phases, the two toners of opposite polarities do not attract each other.

Another reference, U.S. Pat. No. 3,793,205, discloses a developer composition comprising an insulating carrier liquid, a developer pigment of one polarity, and a second developer medium of opposite polarity to the first. The second developer medium enhances the deposition of the first pigment onto the imaging areas by increasing its sensitivity and allowing it to be deposited more heavily. The second developer medium also shields non-imaging background areas from visible contamination.

British patent application No. 2,169,416A discloses a liquid developer composition comprising toner particles associated with a pigment dispersed in a nonpolar liquid, wherein the toner particles are formed with a plurality of fibers of tendrils from a thermoplastic polymer. This application also discloses a process for preparing the disclosed liquid developer. In addition, U.S. Pat. No. 4,476,210 discloses a liquid developer composition and a method of making the developer, which developer comprises a marking particle dispersed in an aliphatic dispersion medium, wherein the marking particle comprises a thermoplastic resin core having an amphipathic block or graft copolymeric steric stabilizer irreversibly chemically or physically anchored to the thermoplastic resin core, with the dye being imbibed in the resin core and being soluble therein and insoluble in the dispersion medium.

Copending application U.S. Ser. No. 197,131 filed May 23, 1988, the disclosure of which is totally incorporated herein by reference, also discloses developer suitable for a process wherein electrostatic latent images formed on the surface of an imaging member are developed in a single step with a liquid developer containing a plurality of first toner particles and a plurality of second toner particles, wherein the first and second toner particles are of opposite polarities and different colors. The developer comprises a resin and a first pigment of one color, second toner particles charged to a polarity opposite to that of the first toner particles and comprising a resin and a second pigment of a color different from that of the first pigment, and a charge director. Further, copending application U.S. Ser. No. 197,131, filed concurrently herewith, entitled "Process for Generating Two-Color Images," with the named inventors P. Keith Watson, Ian D. Morrison, and Melvin D. Croucher, the disclosure of which is totally incorporated herein by reference, discloses a process for generating two-color images, comprising charging an imaging member; creating on the member a latent image comprising three different levels of potential consisting of a high level of potential, an intermediate level of potential, and a low level of potential. In this process, there is provided an electrode having a potential within 100 volts of that of the intermediate level of potential such that an electric field is generated between the imaging member and the electrode, thereby creating a development zone between the electrode and the imaging member. Subsequently, the latent image is developed by introducing into the development zone a liquid developer composition containing first toner particles of one color and second toner particles of another color, said particles being dispersed in a liquid medium, such that the second toner particles are attracted to the high level of potential and the first toner particles are attracted to the low level of potential, with the intermediate level of potential remaining undeveloped. Copending application D/87021 also discloses developer compositions suitable for use in the disclosed process.

The process of charging a photoresponsive imaging member to a single polarity and creating on it an image consisting of at least three different levels of potential of the same polarity is disclosed in U.S. Pat. No. 4,078,929, the disclosure of which is totally incorporated herein by reference. This patent discloses a method of creating two colored images by creating on an imaging surface a charge pattern including an area of first charge as a background area, a second area of greater voltage than the first area, and a third area of lesser voltage than the first area, with the second and third areas functioning as image areas. The charge pattern is developed in a first step with positively charged toner particles of a first color, and, in a subsequent development step, developed with negatively charged toner particles of a second color. Alternatively, charge patterns may be developed with a dry developer containing toners of two different colors in a single development step. According to the teachings of this patent, however, the images produced are of inferior quality compared to those developed in two successive development steps. Also of interest with respect to the tri-level process for generating images is U.S. Pat. No. 4,686,163.

Latent images generated according to the process disclosed in U.S. Pat. No. 4,078,929, hereinafter referred to as tri-level images, usually cannot be developed by sequentially applying two distinct liquid developers of different color and opposite polarity to the latent images because of the nature of liquid developers. While dry toners usually acquire charge by contact with carrier beads of opposite charge, liquid toners generally acquire charge by interaction with ionizable components in the liquid. Accordingly, in dry toners, the countercharges are contained on the carrier particles and are held under control by mechanical forces, while in liquid toners the countercharges are molecularly dispersed in the liquid. Thus, when an electric field is applied to a dry developer, only the charged toner particles migrate, and the countercharges do not migrate to the latent image; when an electric field is applied to a liquid developer, however, both the charged toner particles and the coutercharges dispersed in the liquid migrate under the field. When tri-level images are developed with a liquid developer, the charged toner particles develop the areas of one bias, the background areas of second bias remain undeveloped, and the countercharges contained within the liquid developer tend to neutralize the areas of the third bias. As a consequence, only a degraded image with reduced contrast potential remains to be developed by a second liquid developer containing toner particles charged oppositely to the first toner particles.

Accordingly, while the compositions and processes of the above patents are suitable for their intended purposes, a need continues to exist for improved liquid electrophotographic developers suitable for generating two-color electrophotographic images. There is also a need for liquid developers wherein first and second particles with different colors and opposite polarities are present in the same developer solution. In addition, there is a need for liquid electrophotographic developers capable of developing two-color electrophotographic images in a single step. Further, a need exists for liquid electrophotographic developers wherein first and second particles with different colors and opposite polarities are present in the same developer solution without resulting in agglomeration of the oppositely charged particles to a degree that renders subsequent development with and separation of the particles difficult or impossible. Also, a need continues to exist for liquid electrophotographic developers wherein first and second particles with different colors and opposite polarities are present in the same developer solution, and wherein the same charge director is employed to charge both the positive and the negative particles.

SUMMARY OF THE INVENTION

It is an object of the present invention to provide a liquid electrophotographic developer suitable for generating two-color electrophotographic images.

It is another object of the present invention to provide a liquid developer wherein first and second particles with different colors and opposite polarities are present in the same developer solution.

It is yet another object of the present invention to provide a liquid electrophotographic developer capable of developing two-color electrophotographic images in a single step.

Another object of the present invention is to provide a liquid electrophotographic developer wherein first and second particles with different colors and opposite polarities are present in the same developer solution without resulting in agglomeration of the oppositely charged particles to a degree that renders subsequent development with and separation of the particles difficult or impossible.

Yet another object of the present invention is to provide a liquid electrophotographic developer wherein first and second particles with different colors and opposite polarities are present in the same developer solution, and wherein the particles are colloidally stable in that they do not aggregate as a result of charge attraction.

Still another object of the present invention is to provide a liquid electrophotographic developer wherein first and second particles with different colors and opposite polarities are present in the same developer solution, and wherein the same charge director is employed to charge both the positive and the negative particles.

It is a further object of the present invention to provide a liquid electrophotographic developer suitable for use in a tri-level process for generating two-color electrophotographic images, wherein the photosensitive imaging member is charged to a single polarity and the latent image consists of a high level of potential and low level of potential, and the background areas consist of an intermediate level of potential.

Another object of the present invention is to provide liquid developer compositions suitable for use in a tri-level imaging process for generating two-color electrophotographic images.

Yet another object of the present invention is to provide liquid developer compositions suitable for use in a tri-level process for generating two-color electrophotographic images wherein the developer compositions comprise first and second particles of different colors and opposite polarities.

A further object of the present invention is to provide liquid developer compositions suitable for use in a tri-level process for generating two-color electrophotographic images wherein the developer compositions are stabilized by attaching to the surfaces of the first and second particles polymers that are soluble in the dispersing liquid.

These and other objects of the invention are achieved by providing an electrophotographic liquid developer composition comprising a liquid medium, first toner particles charged to one polarity and comprising a first dye and polymeric cores to which steric stabilizer polymers have been attached, second toner particles charged to a polarity opposite to that of the first toner particles and comprising a second dye of a different color than the first dye and polymeric cores to which steric stabilizer polymers have been attached, and a charge director.

Liquid developer compositions of the present invention contain first and second toner particles of opposite polarity and different colors within a liquid medium. The liquid medium functions as a low conductivity neutral medium in which the other components of the developer are uniformly dispersed. Materials suitable for the liquid medium include high purity aliphatic hydrocarbons with, for example, from 1 to about 25 carbon atoms, and preferably with a viscosity of less than 2 centipoise, such as Parabase®, isoparaffinic hydrocarbons such as Isopar® G, H, K, L, M, available from Exxon Corporation, Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Generally, the liquid medium is present in a large amount in the developer composition, and constitutes that percentage by weight of the developer not accounted for by the other components. The liquid medium is usually present in an amount of from about 80 to about 99.5 percent by weight, although this amount may vary provided that the objectives of the present invention are achieved.

The toner particles contained in the liquid developers of the present invention comprise macroscopic cores of a polymeric material in which is imbibed a dye and to which amphipathic block or grafts stabilizing copolymers have been attached. U.S. Pat. No. 4,476,210, the disclosure of which is totally incorporated herein by reference, discloses a process for preparing such particles. Amphipathic copolymers are those which have one portion that possesses an affinity for one material and another portion that possesses an affinity for another different material. For example, one portion of the polymer might be soluble in a given solvent and the other portion might be insoluble in that solvent. When resin particles having amphipathic copolymeric moieties physically or chemically attached to them are dispersed in a liquid medium, the copolymers function as steric stabilizers by overcoming mutually attractive forces between the particles in the solution; attractive forces between adjacent polymeric particles in the liquid medium are screened by the steric repulsion effect of the stabilizing copolymers, and the particles are thereby maintained separate and prevented from flocculating. Suitable stabilizing copolymers include those containing a portion selected from materials such as acrylates, such as poly(alkyl acrylate) or poly(alkyl methacrylate) with the alkyl group having at least three carbon atoms and up to about 25 carbon atoms, and a portion selected from materials such as poly(N-vinyl-2-pyrrolidone), poly(vinyl acetate), poly(ethyl acrylate, poly(methyl methacrylate), poly(methyl acrylate), polystyrene, and the like. In addition, copolymers based on polyolefins such as polyethylene, wherein the comonomers are vinyl acetate, methacrylic acid, mixtures thereof, and the like, also behave as efficient steric stabilizers. These polyolefin copolymers contain at least 75 mole percent of the polyolefin. One commercially available polyolefin polymer of this type is a poly(ethylene-co-vinyl acetate-co-methacrylic acid) terpolmer with an acid number of 4 to 8 mg KOH/g polymer, available from E. I. DuPont Corporation as Elvax® 4320.

Other examples of stabilizing copolymers include block copolymers such as poly(vinyl acetate-b-dimethyl siloxane), poly(styrene-b-dimethyl siloxane), poly(styrene-b-hydrogenated isoprene), poly(methyl methacrylate-b-dimethylsiloxane), poly(vinyl acetate-b-isobutylene), poly(vinyl acetate-b-2-ethyl hexyl methacrylate), poly(styrene-b-2-ethyl hexyl methacrylate), poly(ethyl methacrylate-b-2-ethyl hexyl methacrylate), and poly(-dimehtylsiloxane-styrene-dimethyl siloxane).

The stabilizing copolymers may also include graft copolymers. The backbone portion of the graft copolymer may be selected from materials such as polyisobutylene; hydrogenated polybutadiene; hydrogenated polyisoprene; polydimethylsiloxane; poly(vinyl toluene); poly(12-hydroxy stearic acid); poly(iso bornyl methacrylate); acrylic and methacrylic polymers of long chain esters of acrylic and methacrylic acid such as stearyl, lauryl, octyl, hexyl, and 2-ethylhexyl; polymeric vinyl esters of long chain acids such as vinyl stearate, vinyl laurate, and vinyl palmitate; polymeric vinyl alkyl ethers, including poly(vinyl ethyl ether), poly(vinyl isopropyl ether), poly(vinyl isobutyl ether), and poly(vinyl n-butyl ether); other polymers of vinyl monomers; and copolymers of the above. Preferred backbones include polyisobutylene, particularly its copolymers with isoprene containing from 1 to 3% unsaturation, polydimethyl siloxane, acrylates such as poly(2-ethylhexyl acrylate), poly(2-ethylhexyl methacrylate), poly(lauryl methacrylate), and copolymers of acrylates or methacrylates with alkyl groups having 8 to 12 carbons and containing from about 0.1 to about 5 percent monomers such as allyl methacrylate, N,N-dimethyl-aminoethyl methacrylate, and benzyl methacrylate to promote the grafting reaction. Suitable monomers for the graft portion of graft polymer stabilizers include vinyl monomers such as vinyl acetate, acrylates, such as methyl acrylate, methyl methacrylate, ethyl acrylate, ethyl methacrylate, acrylonitrile, acrylamide, methacrylonitrile, methacrylamide, acrylic acid, methacrylic acid, maleates such as monoethyl maleate, fumarates such as monoethyl fumarate, styrene, maleic anhydride, maleic acid, and N-vinyl-2-pyrrolidone. Preferred materials include vinyl acetate, N-vinyl-2-pyrrolidone, ethyl acrylate, n-butyl methacrylate and styrene. Generally, the stabilizer is present in an amount of from about 2 percent to about 50 percent by weight with respect to the amount of the monomer to be polymerized into the core material.

The stabilizing copolymers may be generated in situ during the particle formation reaction or made separately by any suitable process. For example, a graft copolymer may be prepared by methods well known in the field of polymer synthesis as described by P. Rempp and E. W. Merrill in "Polymer Synthesis," Hüthig & Wepf Verlag, Basel, Switzerland, 1986, pages 214–219, the disclosure of which is totally incorporated herein by reference. A block copolymer may be prepared by methods well known in the field of polymer synthesis as described by P. Rempp and E. W. Merrill in "Polymer Synthesis," Hüthig & Wepf Verlag, Basel, Switzerland, 1986, pages 220–224, the disclosure of which is totally incorporated herein by reference.

Stabilizing copolymers can affect the polarity and magnitude of the charge later imparted to the toner particles. Accordingly, for the purposes of the present invention, toner particles to be charged positively should possess steric stabilizing copolymers compatible with a positive charge, such as poly(2-ethylhexyl methacrylate-g-N-vinyl-2-pyrrolidone), poly(ethylhexyl acrylate-g-vinyl acetate), poly(2-ethylhexyl acrylate-g-ethyl acrylate), and poly(ethylene-co-vinyl acetate-co-methacrylic acid-g-N-vinyl-2-pyrrolidone), and toner particles to be charged negatively should possess steric stabilizing copolymers compatible with a negative charge, such as polyethylene, poly(ethylene-co-vinyl acetate), and poly(ethylene-co-vinyl acetate-co-methacrylic acid).

Further details concerning particles having stabilizing copolymers attached thereto and processes for the preparation thereof are illustrated in U.S. Pat. No. 4,476,210, the disclosure of which is totally incorporated herein by reference.

After the stabilizing copolymers have been prepared, a monomer or mixture of monomers is added to the stabilizing copolymer, the liquid medium selected for the liquid developer of the present invention, and a polymerization initiator to obtain macroscopic polymeric core particles having chemically or physically attached thereto the sterically stabilizing copolymers. The monomers chosen should be capable of undergoing nonaqueous dispersion polymerization. Thus, the monomers are soluble in the reaction medium, but the polymers formed upon polymerization are insoluble. In addition, the core polymeric material should be one that has a glass transition temperature above about 40° C., so that it will retain a spherical shape when exposed to temperatures of up to 40° C. If the polymeric core collapses at these temperatures, the developer may form a film on a photoreceptor after the liquid medium has evaporated, thus substantially preventing transfer of the developed image to a substrate. Suitable core materials may comprise any suitable thermoplastic resin, and include acrylate polymers and polymers of vinyl monomers, such as poly(vinyl acetate), poly(N-vinyl-2-pyrrolidone), poly(methyl methacrylate), poly(methyl acrylate), poly(ethyl acrylate), poly(ethyl methacrylate), poly(2-ethoxyethyl methacrylate), poly(butoxy ethoxy ethyl methacrylate), poly(dimethyl amino ethyl methacrylate), poly(acrylic acid), poly(methacrylic acid), poly(acrylamide), poly(methacrylamide), poly(acrylonitrile), poly(vinyl) chloride), poly(ureido-ethyl vinyl ether), and polystyrene. Preferred materials include homopolymers of vinyl acetate, N-vinyl-2-pyrrolidone, methyl methacrylate, styrene, and ethyl acrylate, and copolymers of any of these monomers.

The polymeric particles are prepared by adding an excess amount of the core monomer to a solution of the liquid medium containing the stabilizing copolymer in the presence of a free radical initiator such as benzoyl peroxide or azobisisobutyronitrile at atmospheric pressure and under a nitrogen blanket at temperatures of from about 60° C. to about 90° C. Over a period of from about 2 to about 12 hours, the polymeric core is grown in the presence of the stabilizing copolymer, resulting in a dispersion of particles of relatively uniform average particle diameter in the range of from about 0.1 to about 1 micron, although larger particles may also be created. During the growth of the polymeric core, the stabilizing copolymer acts as a steric stabilizer to keep the individual growing particles separate in the dispersion. Also, during the process, the stabilizing copolymers become irreversibly physically or chemically bound to the core polymeric material forming a thermodynamically stable particle. In a typical dispersion polymerization reaction, the dispersion medium in which the reaction is carried out is present in an amount of from about 20 to about 90 percent by weight, and preferably from about 40 to about 70 percent by weight. The monomer or monomers are typically present in an amount of from about 5 to about 70 percent by weight, and preferably from about 15 to about 40 percent by weight; the steric stabilizer is typically present in an amount of from about 0.5 to about 15 percent by weight, and preferably from about 1 to about 10 percent by weight; and the initiator is typically present in an amount of from about 0.1 to about 5 percent by weight, and preferably from about 0.5 to about 3 percent by weight.

After the particles are prepared, they are dyed by any suitable method. One such method is a dye imbibition process as described in U.S. Pat. No. 4,476,210, and entails dissolving the selected dye in a polar solvent such as methanol, glacial acetic acid, ethylene glycol, dimethyl sulfoxide, N,N-dimethyl formamide, and mixtures thereof to form a solution of the dye wherein the dye is present in an amount of from about 5 to about 25, and preferably about 10, percent weight/volume. The polar solvent should be essentially insoluble in the liquid medium selected for the developer, in which the polymeric particles were prepared.

Suitable dyes include those that are highly soluble in the polar solvent and insoluble in the liquid medium. The dye chosen will affect the polarity and the magnitude of the toner particles, although the charge attained by the toner particles is also affected by the resin and the charge control agent chosen. Examples of suitable dyes include Orasol Blue GN, Orasol Blue 2GLN, Orasol Yellow 2GLN, Orasol Red G, Orasol Red 2BL, Orazol Blue BLN, Orasol Black GN, Orasol Black RL, Orasol Yellow 2RLN, Orasol Red 2B, all available from Ciba Geigy Inc., Mississauga, Ontario, Canada; Morfast Blue 100, Morfast Red 101, Morfast Red 104, Morfast Yellow 102, Morfast Black 101, available from Morton Chemical Limited, Ajax, Ontario, Canada; Savinyl Yellow RLS, Savinyl Yellow 2RLS, Savinyl Pink 6BLS, Savinyl Red 3BLS, Savinyl Red GLS, Savinyl Black RLS, available from Sandoz, Mississauga, Ontario, Canada; Neozapon Black X57, available from BASF, Toronto, Ontario, Canada; and Aztrazon Brilliant Red 4G, available from Bayer Corporation, Toronto, Ontario, Canada. Dyes generally are present in an amount of from about 5 to about 30 percent by weight of the core of the toner particle, although other amounts may be present provided that the objectives of the present invention are achieved.

After the dye has been dissolved in the polar solvent, the resulting dye mixture is added dropwise to a dispersion of the polymeric particles wherein the particles are present in the liquid medium in an amount of from about 2 to about 10 percent by weight. During this process, the dye is molecularly incorporated into the cores of the polymeric particles as a result of the polar solvent becoming specifically absorbed into the polymer cores. The process is carried out at temperatures of from about 40 to about 60° C. until an acceptable amount of dye has been imbibed or absorbed by the core particles, typically from about 2 to about 16 hours. Subsequently, the polar solvent may be removed by any suitable technique, such as heating, reduced pressure, distallation, or combinations thereof to yield a relatively concentrated solution containing the first toner particles present in an amount of from about 10 to about 20 percent by weight in the liquid medium. The resulting particles generally comprise from about 1 to about 3 percent by weight of the stabilizing copolymer, from about 92 to about 94 percent by weight of the core material, and about 5 percent of the dye. The toner particles generally should have an average particle diameter of from about 0.1 to about 4 microns, and preferably from about 0.2 to about 2 micons. Second toner particles are then prepared according to the same process except that a different colored dye is employed.

The liquid developer compositions also contain a charge control additive for the purpose of imparting a positive or negative charge to the toner particles. Charge control additives suitable for the present invention include lecithin, available from Fisher Scientific Company, basic barium petronate, available from Witco Chemical Company, and polyisobutylene succinimide, commercially available as OLOA 1200 from Chevron Chemical Company. Selected charge control agents should charge the first toner particles to one polarity and the second toner particles to the opposite polarity. The charge control additive is added to the liquid developer subsequent to formation of the toner particles in the liquid medium; the amount present is determined as a percentage by weight of the developer composition without the charge control agent present. The charge control additive may be present in an amount of from about 0.5 to about 10, and preferably from about 1 to about 4, percent by weight of the solids content of the developer composition without the charge control additive. Within the developer, the particles have a charge to mass ratio of from about 75 to about 110 microcoulombs per gram.

Preparation of the first and second toner particles according to the method illustrated herein results in two separate mixtures of toner particles in the liquid medium, each having a concentration of particles of about 20 percent by weight. To prepare the developer compositions of the present invention, each solution of toner particles is diluted to a desired concentration by adding additional amounts of the liquid medium. Preferably, the final concentration of toner particles in the liquid medium is from about 0.5 to about 8 percent by weight, with the liquid medium being present in an amount of from about 92 to about 99.5 percent by weight. Subsequent to the dilution of each solution of toner particles, the two solutions are combined by simple mixing at ambient conditions to provide a single solution containing the first and second toner particles, with the total concentration of particles in the combined solution being from about 0.5 to about 8 percent by weight. The first and second toner particles of a bipolar developer of the present invention are selected so that the magnitude of the charge on the positive particles is approximately the same as the magnitude of the charge on the negative particles. After the mixture containing the first and second toner particles has been prepared, the selected charge control agent is added in the desired amount, and the mixture is then allowed to stand for at least 24 hours, resulting in a developer composition of the present invention.

The liquid developers of the present invention are suitable for use in imaging processes wherein two-color images are developed in a single step by exposing them to a single liquid developer composition contained in one development housing. One method of forming images to be developed in a single step comprises applying or "writing" areas of charge onto an imaging member in the pattern of the desired image, wherein areas to be developed in one color are formed with a charge of one polarity and areas to be developed in another color are formed with a charge of the opposite polarity.

A preferred method of forming images with respect to the developers of the present invention is the tri-level method, as described herein and in U.S. Pat. No. 4,078,929, the disclosure of which is totally incorporated herein by reference. The tri-level process, as employed in conjunction with the liquid developer composition of the present invention to form two-color images, comprises charging an imaging member; creating on the member a latent image comprising three different levels of potential consisting of a high level of potential, an intermediate level of potential, and a low level of potential; providing an electrode having a potential within 100 volts of that of the intermediate level of potential such that an electric field is generated between the member and the electrode, thereby creating a development zone between the electrode and the imaging member; and developing the latent image by introducing into the development zone the liquid developer composition of the present invention, containing first toner particles of one color and polarity and second toner particles of another color and opposite polarity, the particles being dispersed in a liquid medium, such that the second toner particles are attracted to the high level of potential and the first toner particles are attracted to the low level of potential, with the intermediate level of potential remaining undeveloped.

Imaging members suitable for use with tri-level development processes to form two-color images developed with the developers of the present invention may be one of various types capable of maintaining three distinct levels of potential and suitable for use with liquid developers. The material of which the imaging member is formulated should be of a type that is not subject to attack by the liquid medium component of the developer. Generally, various dielectric or photoconductive insulating materials that are suitable for use in xerographic, ionographic, or other electrophotographic imaging processes may be used, provided that its surface is not subject to attack by the liquid medium selected for the developer composition. Suitable photoreceptor materials include selenium, selenium alloys, amorphous silicon, layered organic materials as disclosed in U.S. Pat. No. 4,265,990, the disclosure of which is totally incorporated herein by reference, and the like.

The photoresponsive imaging member may be negatively charged, positively charged, or both, and the latent image formed on the surface may consist of either a positive or a negative potential, or both. In one embodiment, the image consists of three distinct levels of potential, all being of the same polarity. The levels of potential should be well differentiated, such that they are separated by at least 200 volts, and preferably 400 volts or more. For example, a latent image on an imaging member can consist of areas of potential at 800, 400, and 100 volts. In addition, the levels of potential may consist of ranges of potential. For example, a latent image may consist of a high level of potential ranging from about 500 to about 800 volts, an intermediate level of potential of about 400 volts, and a low level ranging from 0 to about 300 volts. An image having levels of potential that range over a broad area can be generated such that gray areas of one color are developed in the high range and gray areas of another color are developed in the low range, with 100 volts of potential separating the high and low ranges and constituting the intermediate, undeveloped range.

The latent image may be formed on the imaging member by any method suitable for forming a tri-level image, such as those disclosed in U.S. Pat. No. 4,078,929, the disclosure of which is totally incorporated herein by reference. For example, a tri-level charge pattern may be formed on the imaging member by the xerographic method of first uniformly charging the imaging member in the dark to a single polarity, followed by exposing the member of an original having areas both lighter and darker than the backgrond area, such as a piece of gray paper having both white and black images thereon. In a preferred embodiment, a tri-level charge pattern may be formed by optically modulating light as it scans a uniformly charged photoconductive imaging member. In addition, tri-level images can be formed by an ionographic process.

The electrode may be of any type suitable for use in a liquid development system. This electrode is located in the development housing, and should be located from about 0.2 millimeter to about 2 millimeters, and preferably from about 0.5 millimeter to about 0.6 millimeter from the imaging member. The electrode should be maintained at the same polarity and at a voltage close to that of the intermediate level of potential on the imaging member, preferably within 100 volts. Within the development zone created between the electrode and the imaging member, an electric field is created between the electrode and the imaging member, and the difference in potentials between the electrode and the three levels of potential on the imaging member results in the migration of the toner particles to different areas on the imaging member when the liquid developer is introduced into the development zone. Areas of high level potential on the imaging member attract toner particles of one polarity, and areas of low level potential on the imaging member attract toner particles of the other polarity. For example, in one embodiment, areas of high level potential on the imaging member attract negatively charged toner particles, since, within the field created in the development zone, these areas appear positive with respect to the electrode; areas of low level potential on the imaging member attract positively charged toner particles, since, within the field created in the development zone, these areas appear negative with respect to the electrode. Areas of intermediate potential remain undeveloped, since they appear neutral with respect to the electrode.

Specific embodiments of the invention will now be described in detail. These examples are intended to be illustrative, and the invention is not limited to the materials, conditions, or process parameters set forth in these embodiments. All parts and percentages are by weight unless otherwise indicated.

A. PREPARATION OF STERIC STABILIZERS

EXAMPLE A-1

Poly(2-ethylhexyl acrylate-g-ethyl acrylate) graft copolymer is prepared as follows. Into 500 milliliters of Isopar ® G is dissolved 125 milliliters of 2-ethylhexylacrylate, after which the solution is heated to 75° C. and purged with nitrogen for about 30 minutes. To this solution is then added 1.6 grams of benzoyl peroxide to initiate polymerization, and the polymerization proceeds at 75° C. under constant stirring for about 16 hours. A solution of poly(2-ethylhexylacrylate) is obtained. To 280 milliliters of this polymer solution is then added 500 milliliters of Isopar ® G, and the solution is heated to 75° C. and purged with nitrogen for 30 minutes, after which 1.2 grams of azobisisobutyronitrile is added. After heating for a further 2 hours, 12 milliliters of ethyl acrylate is added to the solution, and polymerization is allowed to proceed at 75° C. for 16 hours, after which a clear solution of the graft copolymer is obtained.

EXAMPLE A-2

Poly(2-ethylhexylmethacrylate-g-N-vinyl-2-pyrrolidone) graft copolymer is prepared as follows. To 200 millilters of poly(2-ethylhexyl methacrylate) is added 500 milliliters of Isopar ® G, and the solution heated to 75° C. and purged with nitrogen for 30 minutes, after which 0.3 gram of benzoyl peroxide is added to the solution. After heating for a further 2 hours, 2.0 millilters of N-vinyl-2-pyrrolidone is added to the solution and polymerization is allowed to proceed at 70° C. for a further 16 hours, resulting in a clear solution of the graft copolymer.

EXAMPLE A-3

Poly(ethylene-co-vinyl acetate-co-methacrylic acid-g-N-vinyl-2-pyrrolidone) graft copolymer is prepared as follows. A 12.5 grams portion of poly(ethylene-co-vinyl acetate-co-methacrylic acid) commercially available from E.I.DuPont Corporation as Elvax ® 4320 is dissolved in 500 milliliters of Isopar ® G at 70° C. in a 1 liter three-necked flask under a nitrogen atmosphere. To this solution is then added 0.4 gram of azobisisobutyronitrile. After two hours, 2 milliliters of N-vinyl-2-pyrrolidone is added to the solution and polymerization is allowed to proceed for an additional 12 hours at 70° C., resulting in a clear solution of the graft copolymer.

B. PREPARATION OF STERICALLY STABILIZED POLYMERIC PARTICLES

EXAMPLE B-1

Particles of poly(ethyl acrylate-co-N-vinyl-2-pyrrolidone) stabilized by poly(2-ethylhexyl acrylate-g-ethyl acrylate) are prepared as follow. 800 milliliters of a graft copolymer solution prepared according to the process of Example A-1 are heated to 70° C. and purged with nitrogen for 30 minutes. Subsequently, 5 grams of azobisisobutyronitrile are added to the constantly stirred solution. After 1 hour, 110 milliliters of ethyl acrylate are added to the resulting solution, and the polymerization reaction is allowed to proceed at 70° C. for a further 2 hours. An additional 2.5 grams of azobisisobutyronitrile is then added to the resulting dispersion, and, after a further 1 hour, 40 milliliters of N-vinyl-2-pyrrolidone is added slowly to the dispersion. The polymerization reaction is allowed to proceed for an additional 16 hours with constant stirring. A latex with particles having average diameters of from 0.2 to 0.6 micron is obtained as evidenced by electron microscopy. The solids content of the latex is adjusted to about 16 percent weight/volume by the addition of about 2 liters of Isopar ® G.

EXAMPLE B-2

Particles of poly(N-vinyl-2-pyrrolidone) stabilized by poly(ethylhexyl methacrylate-g-N-vinyl-2-pyrrolidone) are prepared as follows. 700 milliliters of a graft copolymer solution prepared according to the process of Example A-2 are heated to 70° C. and purged with nitrogen for 30 minutes. Subsequently, 1.0 gram of azobisisobutyronitrile is added to the solution, and after a further 1 hour, 230 milliliters of N-vinyl-2-pyrrolidone are added to the solution. The polymerization reaction is allowed to proceed at 70° C. for a further 16 hours under constant stirring, resulting in a latex with particles having average diameters of from 0.2 to 0.6 micron, as evidenced by electron microscopy. The solids content of the latex is adjusted to about 6 percent weight/volume by the addition of about 3 liters of Isopar ® G.

EXAMPLE B-3

Particles of poly(N-vinyl-2-pyrrolidone) stabilized by poly(ethylene-co-vinyl acetate-co-methacrylic acid-g-N-vinyl-2-pyrrolidone) are prepared as follows. 500 milliliters of a graft copolymer solution prepared according to the process of Example A-3 are heated to 70° C. under a nitrogen atmosphere. Subsequently, 4 grams of azobisisobutyronitrile are dissolved in 150 milliliters of N-vinyl-2-pyrrolidone and the mixture is added dropwise to the graft copolymer solution over a period of 30 minutes. Polymerization is allowed to proceed at 70° C. for 12 hours, resulting in a white latex with particles having average diameters of from 0.2 to 0.6 micron, as evidenced by electron microscopy. The solids content of the latex is about 23 percent by weight.

EXAMPLE B-4

Particles of poly(N-vinyl-2-pyrrolidone-co-vinyl acetate) stabilized by poly(ethylene-co-vinyl acetate-co-methacrylic acid) are prepared as follows. Into 100 milliliters of Isopar® G are dissolved 2.5 grams of poly(ethylene-co-vinyl acetate-co-methacrylic acid), commercially available from DuPont as Elvax I 4320, under a nitrogen atmosphere at 80° C. In a separate container, 0.5 gram of azobisisobutyronitrile is dissolved in a mixture of 20 milliliters of N-vinyl-2-pyrrolidone and 10 milliliters of vinyl acetate, and the resulting solution is added dropwise into a three necked flask containing the solution of poly(ethylene-co-vinyl acetate-co-methacrylic acid) over a period of 30 minutes. The polymerization reaction is allowed to proceed for 12 hours at 80° C., resulting in a white latex with particles having average diameters of about 0.3 micron, as evidenced by electron microscopy. The solids content of the latex is about 22 percent by weight.

C. DYEING OF THE STERICALLY STABILIZED POLYMERIC PARTICLES

EXAMPLES C-1 TO C-5

The solids content of each of the latexes of Examples B-1 to B-4 is adjusted to about 6 percent weight/volume by the addition or removal of Isopar® G to the dispersion. Dyes specified in Table I below are dissolved in the amounts indicated in absolute methanol and filtered through a Whatman number 4 filter paper. In each instance, the dyed methanol solution is added dropwise to the latex with constant stirring. Subsequently, the reaction mixture is maintained at 60° C. for 3 hours, after which the methanol is removed by distillation under a pressure of 2 Torr and the resulting dyed latices are filtered through a wire mesh.

TABLE I

| Dyed Latex | Latex | Volume of 6% w/v Latex Used | Amount of Dye Dissolved in Methanol |
|---|---|---|---|
| C-1 | B-1 | 100 mL | 1 g Orasol Red G in 10 mL methanol |
| C-2 | B-2 | 100 mL | 1 g Astrazon Brilliant Red 4G in 10 mL methanol |
| C-3 | B-3 | 100 mL | 1 g Orasol Blue 2GLN in 10 mL methanol |
| C-4 | B-3 | 100 mL | 0.7 g Orasol Blue GN, 0.5 g Orasol Red G, 0.5 g Orasol Yellow 2GLN, and 0.3 g Orasol Black RL in 20 mL methanol |
| C-5 | B-4 | 100 mL | 0.7 g Orasol Blue GN, 0.5 g Orasol Red G, 0.5 g Orasol Yellow 2GLN, and 0.3 g Orasol Black RL in 20 mL methanol |

D. PREPARATION OF BIPOLAR LIQUID DEVELOPERS

EXAMPLES D-1 to D-6

The dyed polymeric particles prepared in Examples C-1 to C-5 are diluted with Isopar® G to a particle concentration of 1.5 percent by weight, and the charge control additive specified below in Table II is added at a concentration of 20 milligrams of charge control agent per gram of dyed particles. The resulting mixtures are then allowed to age for 24 hours. Each of the mixtures exhibits a charge to mass ratio of from about 75 to about 110 microcoulombs per gram. Bipolar liquid developers are then prepared by combining two of the aged mixtures, one containing positively charged particles and one containing negatively charged particles. For example, bipolar developer D-1 contains equal volumes of the dyed latex prepared in Example C-1 and the dyed latex prepared in Example C-3. Both aged mixtures contain the same charge director and both aged mixtures are present in equal proportions by weight. The mixed bipolar developers are then aged for a further 24 hours before use.

TABLE II

| Bipolar Developer | Dyed Latices Contained in Bipolar Developer | Charge Control Agent and Concentration (w/w of Solids in Developer) | Charge on Particles |
|---|---|---|---|
| D-1 | C-1 and C-3 | lecithin, 20 mg/g | red-positive blue-negative |
| D-2 | C-2 and C-3 | basic barium petronate, 20 mg/g | red-positive blue-negative |
| D-3 | C-2 and C-4 | basic barium petronate, 20 mg/g | red-positive black-negative |
| D-4 | C-2 and C-5 | basic barium petronate, 20 mg/g | red-positive black-negative |
| D-5 | C-2 and C-3 | lecithin, 20 mg/g | red-positive blue-negative |
| D-6 | C-2 and C-3 | OLOA 1200, 40 mg/g | red-positive blue-negative |

Each of the bipolar liquid developers is placed in a container containing 2 electrodes 1 centimeter apart, and a potential of 1,500 volts is applied between the electrodes. The positively charged particles accumulate on the negative electrode and the negatively charged particles accumulate on the positive electrode. The color of the particles on each electrode is measured with a Pacific Scientific Spectograd Colorimeter, and the results are compared to images prepared from liquid developers containing only the particles that accumulate on that electrode, in order to measure the color separation of the bipolar developers in an electric field. Each of the bipolar developers in Table II exhibits a color separation of essentially 100 percent.

Imaging tests are also performed with each of the bipolar liquid developers in a laboratory test fixture consisting of a Savin 880 copier modified to produce tri-level two-color images according to the method of U.S. Pat. No. 4,078,929. Each of developers D-1 to D-6 develops two-color images in a single development step, which images transfer from the photoreceptor to plain paper. The optical densities of images formed with this process and these developers are in excess of 1.0, indicating good transfer of the developer from the photoreceptor to plain paper.

These examples are illustrative in nature and are not intended to limit the scope of the invention. Other embodiments of the present invention may occur to those skilled in the art, and these are included within the scope of the claims.

We claim:

1. An electrophotographic liquid developer composition comprising a liquid medium, first toner particles charged to one polarity and comprising a first dye and polymeric cores to which steric stabilizing copolymers have been attached, second toner particles charged to a polarity opposite to that of the first toner particles which comprise a second dye of a different color that that of the first dye and polymeric cores to which steric stabilizing copolymers have been attached, and a charge director.

2. An electrophotographic liquid developer composition according to claim 1 wherein said first toner particles and said second toner particles are from about 0.1 to about 4 microns in average volume particle diameter.

3. An electrophotographic developer composition according to claim 1 wherein said liquid medium is an isoparaffinic hydrocarbon.

4. An electrophotographic developer composition according to claim 1 wherein said first toner particles comprise polymeric cores of a material selected from the group consisting of poly(N-vinyl-2-pyrrolidone) and poly(ethyl acrylate-co-N-vinyl-2-pyrrolidone).

5. An electrophotographic developer composition according to claim 1 wherein said second toner particles comprise polymeric cores of a material selected from the group consisting of poly(N-vinyl-2-pyrrolidone) and poly(vinyl acetate-co-N-vinyl-2-pyrrolidone).

6. An electrophotographic developer composition according to claim 1 wherein said first toner particles and said second toner particles comprise polymeric cores of a material selected from the group consisting of poly(N-vinyl-2-pyrrolidone), poly(vinyl acetate-co-N-vinyl-2-pyrrolidone), and poly(ethyl acrylate-co-N-vinyl-2-pyrrolidone).

7. An electrophotographic developer composition according to claim 1 wherein said first toner particles comprise stabilizing copolymers selected from the group consisting of poly(2-ethylhexyl acrylate), poly(2-ethylhexyl methacrylate), copolymers of 2-ethylhexyl acrylate and ethyl acrylate, copolymers of 2-ethylhexyl acrylate and N-vinyl-2-pyrrolidone, copolymers of 2-ethylhexyl methacrylate and ethyl acrylate, and copolymers of 2-ethylhexyl methacrylate and N-vinyl-2-pyrrolidone.

8. An electrophotographic developer composition according to claim 1 wherein said second toner particles comprise stabilizing copolymers selected from the group consisting of polyethylene, copolymers of polyethylene and vinyl acetate, copolymers of polyethylene and methacrylic acid, and copolymers of polyethylene and N-vinyl-2-pyrrolidone.

9. An electrophotographic developer composition according to claim 1 wherein said first toner particles and said second toner particles comprise stabilizing copolymers selected from the group consisting of poly(2-ethylhexyl acrylate), poly(2-ethylhexyl methacrylate), copolymers of 2-ethylhexyl acrylate and ethyl acrylate, copolymers of 2-ethylhexyl acrylate and N-vinyl-2-pyrrolidone, copolymers of 2-ethylhexyl methacrylate and ethyl acrylate, copolymers of 2-ethylhexyl methacrylate and N-vinyl-2-pyrrolidone, polyethylene, copolymers of polyethylene and vinyl acetate, copolymers of polyethylene and methacrylic acid, and copolymers of polyethylene and N-vinyl-2-pyrrolidone.

10. An electrophotographic developer composition according to claim 1 wherein said first toner particles comprise a dye selected from the group consisting of Orasol Red G, Astrazon Brilliant Red 4G, and mixtures thereof.

11. An electrophotographic developer composition according to claim 1 wherein said second toner particles comprise a dye selected from the group consisting of Orasol Blue 2GLN, Orasol Red G, Orasol Yellow 2GLN, Orasol Black RL, and mixtures thereof.

12. An electrophotographic developer composition according to claim 1 wherein said first toner particles and said second toner particles comprise from about 2 to about 10 percent by weight of a stabilizing copolymer, from about 85 to about 95 percent by weight of a polymeric core material, and from about 3 to about 5 percent of a dye.

13. An electrophotographic developer composition according to claim 1 wherein said first toner particles and said second toner particles are present in a total amount of from about 0.5 to about 8 percent by weight of the developer composition.

14. An electrophotographic developer composition according to claim 1 wherein said charge director is selected from the group consisting of lecithin, basic barium petronate, and polyisobutylene succinimide.

15. An electrophotographic developer composition according to claim 1 wherein said charge director is present in an amount of from about 0.5 to about 10 percent by weight of the solids content of the developer composition.

16. An electrophotographic developer composition according to claim 1 wherein said first toner particles are positively charged and said second toner particles are negatively charged.

17. An electrophotographic developer composition according to claim 16 wherein said first toner particles are charged to from about +75 to about +110 microcoulombs per gram and said second toner particles are charged to from about −75 to about −110 microcoulombs per gram.

18. An electrophotographic developer composition according to claim 1 wherein said first toner particles are negatively charged and said second toner particles are positively charged.

19. An electrophotographic developer composition according to claim 18 wherein said first toner particles are charged to from about −75 to about −110 microcoulombs per gram and said second toner particles are charged to from about +75 to about +110 microcoulombs per gram.

* * * * *